United States Patent [19]

Austin

[11] 4,201,331

[45] May 6, 1980

[54] BUTTERFLY CARTON AND BLANK FOR FORMING SAME

[75] Inventor: John J. Austin, Hinsdale, Ill.

[73] Assignee: Champion International Corporation, Stamford, Conn.

[21] Appl. No.: 24,877

[22] Filed: Mar. 28, 1979

[51] Int. Cl.[2] ..... B65D 5/10; B65D 43/14

[52] U.S. Cl. ..... 229/39 R; 229/8; 229/45 R

[58] Field of Search ..... 229/8, 39 R, 45

[56] References Cited

U.S. PATENT DOCUMENTS

| | | | |
|---|---|---|---|
| 285,706 | 9/1883 | Tatum | 229/39 R |
| 2,692,721 | 10/1954 | Pennebaker et al. | 229/39 R X |
| 2,797,041 | 6/1957 | Rondone | 229/39 R |
| 3,153,503 | 10/1964 | Goldstein | 229/8 |
| 3,229,891 | 1/1966 | Edelman | 229/45 X |
| 3,494,536 | 2/1970 | Henry | 229/39 R |
| 3,768,720 | 10/1973 | Bundy | 229/39 R X |

FOREIGN PATENT DOCUMENTS

| | | | |
|---|---|---|---|
| 1307317 | 9/1962 | France | 229/8 |
| 1334426 | 7/1963 | France | 229/8 |
| 91734 | 10/1938 | Sweden | 229/39 R |
| 262141 | 9/1949 | Switzerland | 229/8 |
| 264157 | 1/1950 | Switzerland | 229/8 |

*Primary Examiner*—Davis T. Moorhead
*Attorney, Agent, or Firm*—Evelyn M. Sommer

[57] ABSTRACT

A butterfly carton made from a single blank with an auto-erecting lock bottom, and a recloseable top portion including an attractive butterfly wing shaped design. The butterfly carton is of a knock-down variety which can be shipped in a flattened configuration and is further provided with an auto-erecting lock bottom to facilitate erection of the carton. The carton is provided with movable triangular shaped locking portions, pivotally connected to the top of the carton, which are interengaged with V-shaped slots provided in the side wall of the carton, to securely lock the carton in the closed condition. The top portion of the carton is also provided with butterfly wing shaped tabs which are interengaged to provide secondary locking of the carton. In addition, the butterfly wing shaped tabs are maintained at an angle relative to the top of the carton to create an aesthetically pleasing design.

10 Claims, 8 Drawing Figures

BUTTERFLY CARTON AND BLANK FOR FORMING SAME

The subject invention relates to a new and improved butterfly top carton and a blank for forming the same for holding elongated bottles and the like. More particularly, the subject invention relates to an aesthetically pleasing carton which includes an attractive recloseable locking top portion and an auto erecting lock bottom. The top portion of the carton is locked in the closed condition by an interengagement between generally triangular shaped locking tabs, which are pivotally connected to the top portion of the carton, and V-shaped slots in the associated side panels of the carton. Further, an interengagement between a pair of butterfly wing shaped tabs, disposed at the top of the carton, provide a secondary locking of the carton. In addition, buttressing tabs are provided along the top of the carton which abut the butterfly shaped tabs and cause the tabs to be disposed at an angle relative to the top of the carton creating an aesthetically pleasing graphic theme for the carton.

The carton is intended to be used for storage and transporation of bottles. To reduce shipping cost, it is required that such cartons be shipped from the manufacturer in the flattened configuration. It is desirable that the carton be readily erected by the wholesaler, and provide a pleasing appearance to encourage sales.

Therefore, it is an object of the subject invention to provide a carton which is capable of being securely closed and easily reopened.

It is a further object of the subject invention to provide a carton that is both attractive and aesthetically pleasing.

It is still a further object of the subject invention to provide a carton of the knock down variety which can be shipped in a flattened configuration.

It is another object of the subject invention to provide a carton which can be quickly and easily erected.

Further objects and advantages of the subject invention will become apparent from the following detailed description taken in conjunction with the drawings in which.

Figure 1:
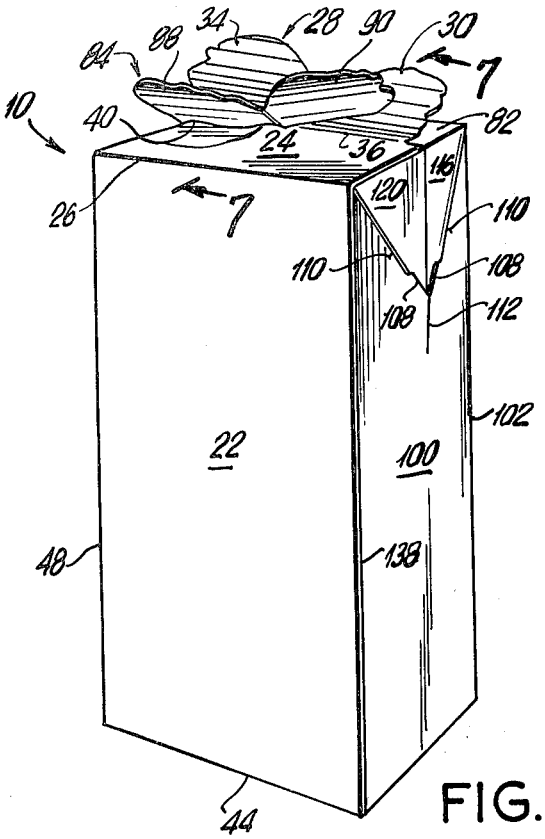
FIG. 1 is a perspective view of the closed carton of the subject invention.
Figure 2:
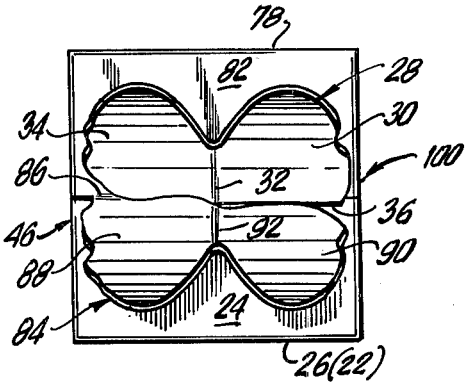
FIG. 2 is a top plan view of the carton of the subject invention illustrating the butterfly wing shaped tabs in a locked configuration.

Referring to FIG. 1, the butterfly top carton of the subject invention is designated generally by the numeral 10 and is intended for the storage and transportation of bottles. The carton is generally rectangular in shape with the top portion 12 being functional while additionally having an aesthetically pleasing butterfly wing configuration.

Figure 8:
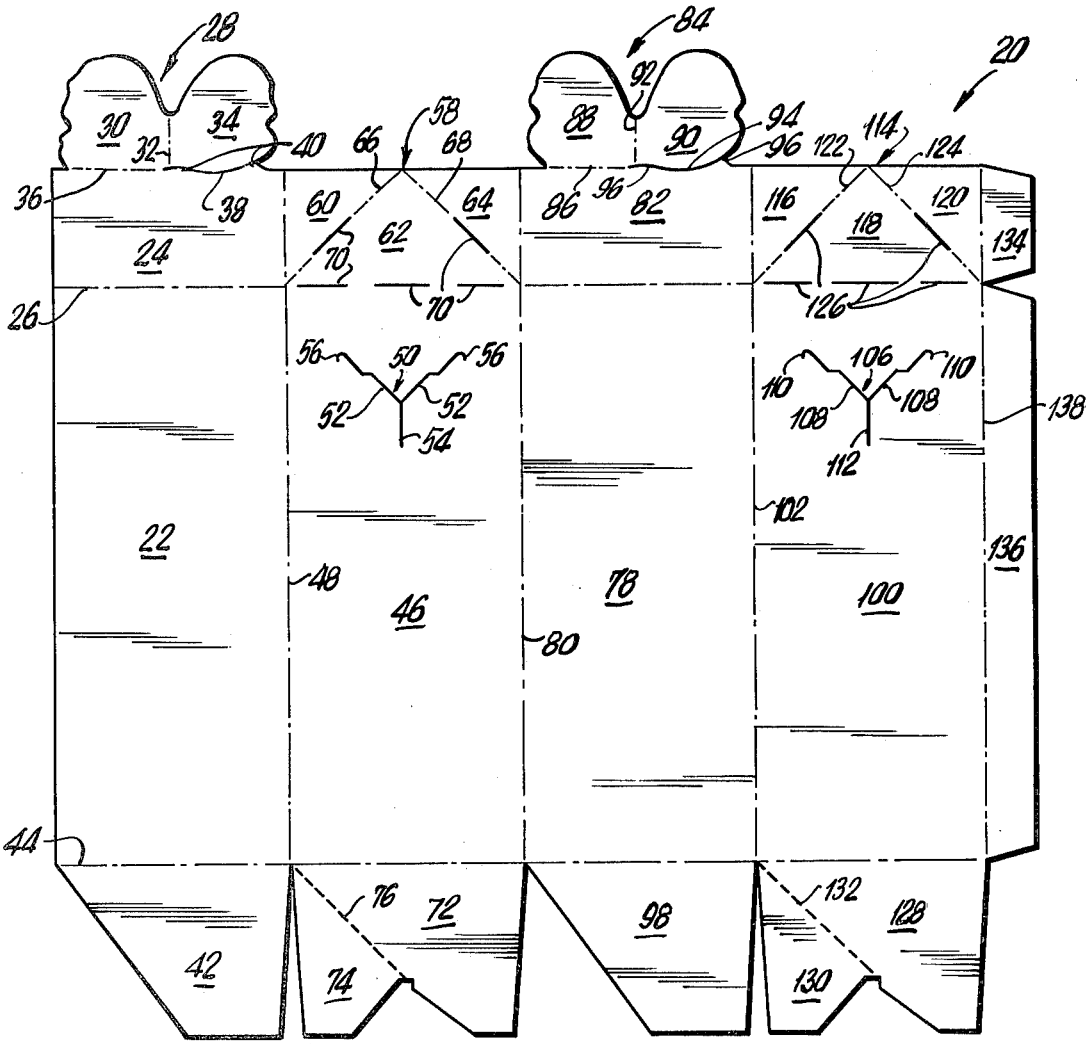
FIG. 8 is a plan view of the blank of the subject invention.

FIG. 8 illustrates the blank 20 for forming the carton of the subject invention. Blank 20 includes a first side panel 22 hingedly connected to a first top panel 24 along fold line 26. A butterfly tab 28 of generally butterfly wing configuration includes a first wing segment 30 hingedly connected along fold line 32 to a second wing segment 34. The butterfly tab 28 is connected to the first top panel 24 along fold line 36, running between the first top panel 24 and the first wing segment 30, with the fold line 36 being disposed generally orthagonal to fold line 32 between the wing segments 30 and 34. An arcuate cut line 38 functions to separate the first top panel 24 and the second wing segment 34 of the butterfly tab 28 and in addition, defines two buttressing tabs 40 which aid in maintaining the butterfly tabs at an angle relative to the top of the erected carton, as more fully described hereinafter. A first minor bottom panel 42 is hingedly connected to the first side panel 22 along fold line 44.

A first locking side panel 46 is hingedly connected to the first side panel 22 along fold line 48, and includes an irregular V-shaped slot 50 which defines two angled tabs 52. A nick 54 is provided at the apex of the V-shaped slot 50 and along with the angled tabs 52 aid in the locking of the erected carton, as more fully described hereinafter. In the preferred embodiment, the V-shaped slot includes hooks 56 at the opposed ends thereof which prevent tearing of the first locking side panel 46 along the line of the V-shaped slot 50 due to repeated openings and closings of the carton 10. A first locking top panel 58 is hingedly connected to the first locking side panel 46 and the first top panel 24 along fold lines 26 and 48 respectively. The first locking top panel 58 includes three generally triangular sections 60, 62 and 64 respectively hingedly connected to each other along fold lines 66 and 68. In the preferred embodiment, cuts 70 are provided along the hinge lines 66 and 68 and in the hinged connection 26 between the first locking top panel 58 and the first locking side panel 46 to allow for easier bending of these panels during closure of the carton.

A first major bottom panel 72 is hingedly connected to the first locking side panel 46 along fold line 44, and includes a first folding section 74 hingedly connected thereto along fold line 76. A second side panel 78 which is hingedly connected to the first locking side panel 46 along fold line 80, substantially conforms to the configuration of the first side panel 22. A second top panel 82 is hingedly connected to the second side panel 78 and the first locking top panel 58 along fold lines 26 and 80 respectively. A butterfly tab 84 whose configuration substantially conforms to the configuration of the first butterfly tab 28 is hingedly connected to the second top panel 82 along fold line 86 extending between the second top panel 82 and the first wing segment 88 of the second butterfly tab 84. A second wing segment 90 of the second butterfly tab is hingedly connected to the first wing segment 88 along fold line 92 and is separated from the second top panel 82 by cut line 94 which defines buttressing tabs 96.

A second minor bottom panel 98 is hingedly connected to the second side panel 78 along fold lines 44. A second locking side panel 100, which is hingedly connected to the second side panel 78 along fold line 102, substantially conforms to the configuration of the first locking side panel 46. The second locking side panel 100 includes an irregular V-shaped slot 106 which defines angled tabs 108, and includes hooks 110 at the opposed ends thereof. The second locking side panel 100 is also provided with a nick 112 disposed at the apex of the V-shaped slot. A second locking top panel 114, which substantially conforms to the configuration of the first locking top panel 58, is hingedly connected to the second locking side panel 100 and the second top panel 82 along fold lines 26 and 102 respectively. The second locking top panel 114 includes three triangular sections 116, 118, and 120 respectively hingedly connected to each other along fold lines 122 and 124. Additional cut lines 126 are provided along fold lines 122 and 124 and fold line 26 between the second locking top panel 114 and the second locking side panel 100 to permit easier bending of the sections.

A second major bottom panel 128 is hingedly connected to the second locking side panel 100 along fold line 44 and includes a second folding section 130 hingedly connected thereto along fold line 132. First and second manufacturer's glue flaps 134 and 136 are respectively hingedly connected to the second locking top panel 114 and the second locking side panel 100 along fold line 138.

The subject carton is intended to be glued and folded into a flattened configuration by the carton manufacturer to allow for reduced shipping costs. The bottom panels 42, 72, 98 and 128 are folded upwardly along their respective fold lines. The first and second folding sections 74 and 130 are folded back into an abutting relation with the major bottom panels 72 and 128. Then the first side panel 22 and the second locking side panel 100 are folded inwardly along the fold lines 48 and 102 respectively, forming the flattened configuration. Next, the inner surface of the folding sections 74 and 130 are adhesively joined with the outer surface of the minor bottom panels 42 and 98 respectively. The first and second manufacturer's glue flaps 134 and 136 are adhesively joined with the inner surfaces of the first top panel 24 and the first side panel 22 respectively.

When a carton of the subject invention reaches the wholesaler, it is erected simply by expanding the flattened configuration, by separating fold lines 80 and 138 from their abutting relation, thereby forming a rectangular configuration such that the side panels 22 and 78 are parallel to each other and in an orthogonal relationship to the locking side panels 46 and 100. This results in the automatic erection of the lock bottom, and an interengagement between the bottom panels, which in turn prevents the carton from collapsing. The carton can be collapsed only by pushing inwardly at the center of the bottom of the carton thereby releasing the interengagement of the bottom panels.

Figure 3:
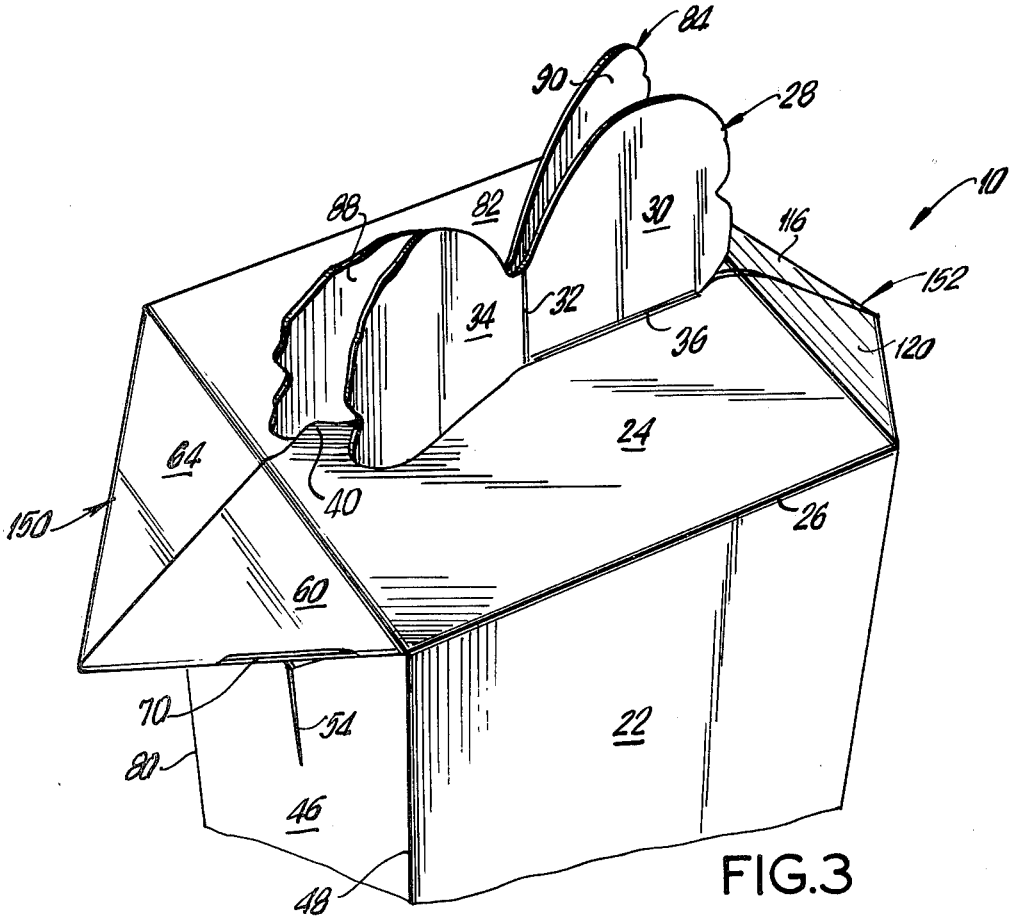
FIG. 3 is a perspective view of the top portion of the carton of the subject invention illustrating a partial closure of the top portion.
Figure 4:
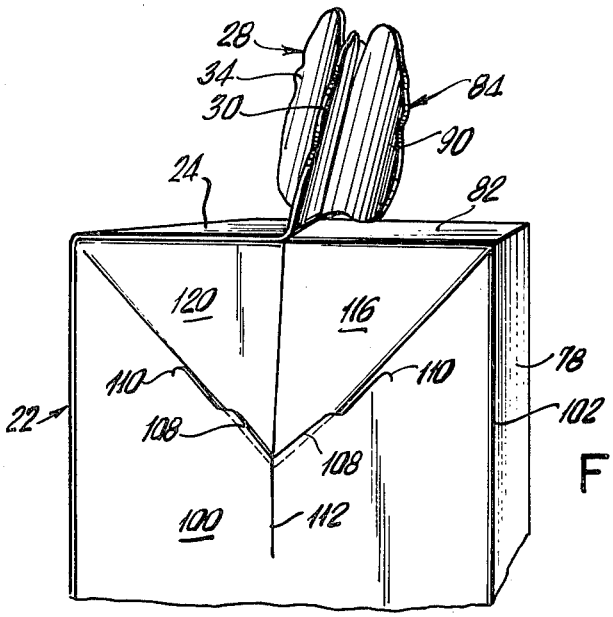
FIG. 4 is a perspective view of the top portion of the carton of the subject invention illustrating the interengagement of a triangular shaped tab with a V-shaped slot.

After the carton has been filled, it is easily closed. The locking top panels 58 and 114 are pushed outwardly at the top center of the panels. This results in the top panels 24 and 82 being drawn together forming a planar closed top with the butterfly tabs 28 and 84 in an abutting upright position as illustrated in FIG. 3. Triangular shaped tabs 150 and 152 are formed by the overlapping of the triangular sections of the locking top panels 58 and 114. The triangular shaped tabs 150 and 152 are then pivoted downwardly and inserted into the associated V-shaped slots 50 and 106 in the locking side panels 46 and 100. While the configuration of the V-shaped slots 50 and 106 substantially conform to the configuration of the triangular shaped tabs 150 and 152 a positive locking is achieved due to the interengagement between the triangular shaped tabs 150 and 152 and the angled tabs 52 and 108, as illustrated in FIG. 4. The nicks 54 and 112 are provided to allow the slots 50 and 106 to be temporarily enlarged during insertion of the triangular shaped tabs 150 and 152. The interengagement locks the carton in the closed position. The hooks 56 and 110 are provided at the opposed ends of the V-shaped slots 50 and 106 to prevent the carton from being torn along the line of the V-shaped slots due to repeated stretching of the slots during closure of the carton.

Figure 5:
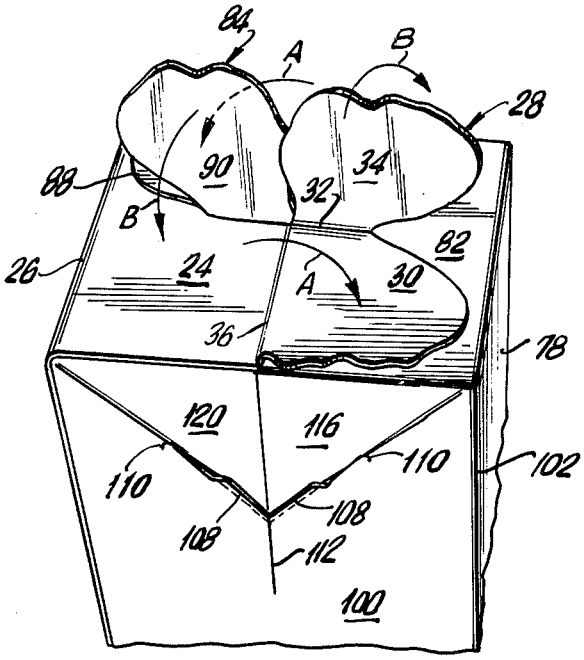
FIGS. 5 and 6 are perspective views of the top portion of the carton of the subject invention illustrating, in sequence, locking of the butterfly wing shaped tabs.
Figure 6:
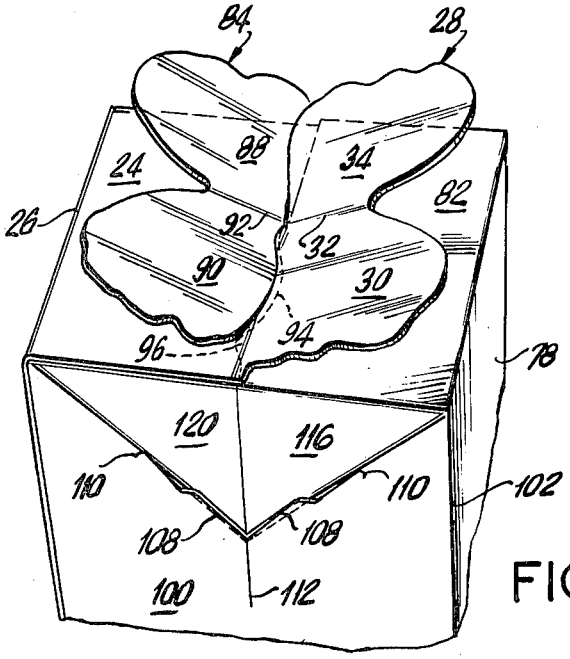
Figure 7:
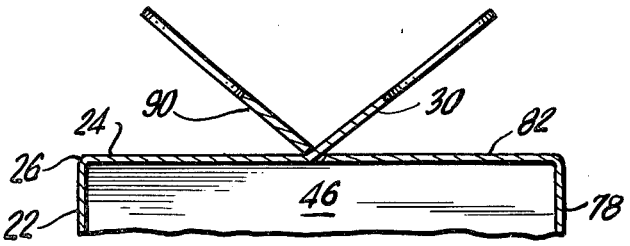
FIG. 7 is a cross-sectional view of the top portion of the carton of the subject invention taken along line 7—7 of FIG. 1 and illustrating the final locked position of the butterfly wing shaped tabs.

The butterfly tabs 28 and 84 are then interengaged by first pushing the first wing segments 30 and 88 into an abutting relationship with the opposed top panel as illustrated by arrows A in FIG. 5, resulting in the second wing segments 34 and 90 being disposed generally perpendicularly upright relative to the top of the carton. In the next folding step, the second wing segments 34 and 90 are pushed downwardly towards the top of the carton as indicated by arrows B in FIG. 5. This interengagement provides a secondary locking for the top portion of the carton. When the interengagement is complete, the buttressing tabs 40 and 96, which abut against the opposed first wing segments 88 and 30 respectively, as illustrated in the sectional view in FIG. 6, will cause the butterfly tabs 28 and 84 to be maintained at an angle relative to the top of the box, as illustrated in FIG. 7. Thus, in addition to providing secondary locking of the carton, the tabs provide an aesthetically pleasing design simulating a butterfly.

When it is necessary for the carton 10 to be reopened to obtain access to the contents therein, the butterfly tabs 28 and 84 are disengaged by reversing the engaging procedure whereupon the triangular shaped tabs 150 and 152 are popped out of the respective V-shaped slots 50 and 106 in the locking side panels 46 and 100 allowing the carton 10 to be opened. The subject carton is capable of being repeatedly closed and reopened.

Accordingly, there is provided a new and improved butterfly top carton and blank for forming same for holding elongated bottles. The carton is provided with dual locking mechanisms which afford a secure locking of the carton while additionally providing an aesthetically pleasing attractive design. Movable triangular shaped locking portions which are pivotally connected to the top of the carton are interengaged with V-shaped slots provided in the side wall of the carton. Butterfly wing shaped tabs, provided along the top of the carton are interengaged forming a secondary locking of the carton. The double locking of the top portion of the subject invention affords a highly reliable closure for the carton. In addition, buttressing tabs are provided along the top edges of the top panels which abut the butterfly shaped wing tabs such that they are disposed at an angle relative to the top of the carton for creating an attractive appearance. Further, the carton can be shipped to the manufacturer in a flattened configuration, thereby saving shipping costs and can be readily erected by the wholesaler. The subject carton can be easily closed and reopened employing the new and improved locking means as described above.

Preferably the carton of the subject invention is formed of a single sheet of cardboard blank which may be coated on one side to facilitate the printing of indicia thereon. It is noted that although the hingedly connected tabs disposed at the top of the carton are shown and illustrated as being of a butterfly configuration, it is readily apparent that other aesthetically pleasing configurations may also be die-cut into the blank, as for example the tabs may be annular in configuration, triangular or other shapes which provide an aesthetically pleasing graphic theme for the carton. Although the present invention has been described with reference to a specific embodiment such reference has been made for purely illustrative purposes and various modifications in the details included therein may be made without departing from the scope and spirit of the invention as will be obvious to those skilled in the art.

What is claimed is:

1. A butterfly top carton of generally tubular configuration having a recloseable top portion comprising:

a generally rectangular, tubular side wall including alternatively hingedly connected side panels and locking side panels, each said locking side panel including an irregular V-shaped slot disposed in the upper portion thereof, said V-shaped slot defining a plurality of angled tabs to maintain said top portion of said carton in the closed condition;

a bottom panel connected to said side wall;

two top panels, each respectively hingedly connected along a bottom edge thereof to the top edge of a side panel;

two butterfly tabs, including hingedly connected first and second wing segments, each said first wing segment being hingedly connected to a top panel along a line generally orthagonal to the hinged connection between said first and second wing segments, and with each said top panel further including buttressing tabs disposed along the edge thereof adjacent the hinged connection with the associated first wing segment and abutting the first wing segment associated with the opposed top panel; and two locking top panels of generally triangular configuration and including an inner and an outer layer, with the base portion of each respective inner layer being hingedly connected to the top edge of a locking side panel and with the base portion of each respective outer layer being hingedly connected to the aligned side edges of said top panels, each of said locking side panels being formed of three overlapping, hingedly connected, generally triangular sections whereby, in the closed condition of the carton, each locking top panel is coplanar and interengaged with the associated locking side panel, with a portion thereof extending through said V-shaped slot and internally of said locking side panel for maintaining said top portion in a locked condition, and the butterfly tabs are interengaged such that each said butterfly tab overlies the opposed top panel, and is maintained at an angle relative to the top of the carton by said buttressing tabs abutting the first wing segments thereby providing a secondary locking of the carton.

2. A butterfly top carton as in claim 1 wherein each said locking side panel includes a nick disposed at the apex of said V-shaped slot to allow a temporary enlargement of said slot to facilitate the insertion of said locking top panels therein.

3. A butterfly top carton as in claim 1 wherein said bottom panel includes two major bottom panels and two minor bottom panels which automatically interengage upon erection of said carton to provide a closed bottom portion.

4. A butterfly top carton as in claim 1 wherein cuts are provided along the hinged connection between each said inner layer of said locking top panel and each locking side panel, and along the hinged connections between the three generally triangular sections of each of the locking top panels to facilitate the bending of said locking top panels during closure of the carton.

5. A butterfly top carton as in claim 1 formed of a single sheet of cardboard blank.

6. A butterfly top carton as in claim 1 wherein each said V-shaped slot includes hooked portions disposed at the opposed ends of said slot to prevent tearing of the carton along the lines of said V-shaped slot.

7. A blank made of paperboard and adapted to be folded into a butterfly top carton of generally tubular configuration having a recloseable top portion comprising:

a first side panel;

a first minor bottom panel hingedly connected to said first side panel;

a first top panel hingedly connected to said first side panel;

a first butterfly tab including hingedly connected first and second wing segments, said first butterfly tab being hingedly connected to said first side panel along a line between said first wing segment and said first top panel, said hinged connection being generally orthagonal to the hinged connection between said first and second wing segments, said second wing segment being spaced from said first top panel by an arcuate cut line, said arcuate cut line defining two buttressing tabs along the edge of said first of top panel;

a first locking side panel hingedly connected to said first side panel and including an irregular V-shaped slot disposed in the upper portion thereof, said V-shaped slot defining a plurality of angled tabs;

a first major bottom panel hingedly connected to said first locking side panel;

a first locking top panel respectively hingedly connected to both said locking side panel and said first top panel and including three respectively hingedly connected generally triangular sections;

a second side panel which is hingedly connected to said first locking side panel and which substantially conforms to the configuration of said first side panel;

a second minor bottom panel hingedly connected to said second side panel which substantially conforms to the configuration of said first minor bottom panel;

a second top panel respectively hingedly connected to both said second side panel and said first locking top panel and which substantially conforms to the configuration of said first top panel;

a second butterfly tab including hingedly connected first and second wing segments, said second butterfly tab being hingedly connected to said second top panel along a line between said first wing segment and said second top panel, said hinged connection being generally orthagonal to the hinge connection between said first and second wing segments, said second wing segment being spaced from said second top panel by an arcuate cut line, said arcuate cut line defining two buttressing tabs along the edge of said second top panel;

a second locking side panel hingedly connected to said second side panel and which substantially conforms to the configuration of said first locking side panel, and including an irregular V-shaped cut disposed in the upper portion thereof;

a major bottom panel hingedly connected to said second locking side panel;

a second locking top panel respectively hingedly connected to both said second locking side panel and said second top panel and substantially conforming to the configuration of said first locking top panel and including three respectively hingedly connected triangular sections;

a first manufacturer's glue flap hingedly connected to the side edge of said second locking top panel; and a second manufacturer's glue flap hingedly connected to the side edge of said second locking side panel.

8. A blank as in claim 7 wherein each said locking side panel includes a nick disposed at the apex of said V-shaped slot.

9. A blank as in claim 7 wherein cuts are provided along the hinged connections between each said locking side panel and each said locking top panel, and along the hinged connections between the three generally triangular sections of each of the locking top panels.

10. A blank as in claim 7 wherein each said V-shaped slot includes hooked portions disposed at the opposed ends of said slot.

* * * * *